US006394091B1

(12) United States Patent
Giorgini

(10) Patent No.: US 6,394,091 B1
(45) Date of Patent: May 28, 2002

(54) BREATHING APPARATUS

(75) Inventor: Eugene Giorgini, Cheektowaga, NY (US)

(73) Assignee: Scott Technologies, Inc., Cleveland, OH (US)

( * ) Notice: Subject to any disclaimer, the term of this patent is extended or adjusted under 35 U.S.C. 154(b) by 0 days.

(21) Appl. No.: 09/180,985

(22) PCT Filed: Jun. 2, 1997

(86) PCT No.: PCT/US97/09487

§ 371 (c)(1),
(2), (4) Date: Jul. 21, 1999

(87) PCT Pub. No.: WO97/46281

PCT Pub. Date: Dec. 11, 1997

Related U.S. Application Data

(60) Provisional application No. 60/022,087, filed on Jun. 5, 1996.

(51) Int. Cl.[7] ..... A62B 18/02

(52) U.S. Cl. ..... 128/206.21; 128/206.15; 128/200.27; 128/200.28; 128/205.24; 128/201.28

(58) Field of Search ..... 128/206.21, 206.15, 128/200.27, 200.28, 205.24, 201.28, 205.22, 204.26; 137/505.46

(56) References Cited

U.S. PATENT DOCUMENTS 4,276,877 A * 7/1981 Gdulla ..... 128/200.27
4,411,285 A * 10/1983 Oswell ..... 128/205.24
4,608,976 A * 9/1986 Suchy ..... 128/204.26
5,036,846 A * 8/1991 Aulgur et al. ..... 128/207.11
5,460,175 A * 10/1995 Foote et al. ..... 128/205.24

* cited by examiner

*Primary Examiner*—John G. Weiss
*Assistant Examiner*—Michael Mendoza
(74) *Attorney, Agent, or Firm*—Ralph E. Jocke; Daniel D. Wasil; Walker & Jocke

(57) ABSTRACT

A breathing apparatus includes a regulator which delivers air to a user wearing a mask. The regulator is connected to the mask through an adaptor. The adaptor includes an exhalation valve which enables the user's breath to pass out of the adaptor to atmosphere. The regulator includes a sensing diaphragm that is movable responsive to pressure in the mask. A main valve delivers air to the mask responsive to opening of a pilot valve. The pilot valve includes a pilot opening. A lever moves in response to the sensing diaphragm to open the pilot opening which causes flow through the main valve. Air from the main valve is also delivered to a positive pressure chamber. Pressure in the positive pressure chamber moves a positive pressure diaphragm which causes a positive pressure spring to biasingly engage the sensing diaphragm. The biasing of the sensing diaphragm causes the regulator to maintain a positive pressure in the mask. Positive pressure is discontinued by relieving pressure form the positive pressure chamber by manually actuating a vent valve.

30 Claims, 8 Drawing Sheets

BREATHING APPARATUS

This application claims the benefit of provisional application No. 60/022,087 filed Jun. 5, 1996.

TECHNICAL FIELD

This invention relates to devices for delivering breathing air to a user. Specifically, this invention relates to a breathing apparatus for use in toxic environments that delivers breathing air to a user through a mask which is maintained at a positive pressure.

BACKGROUND ART

Numerous types of devices for delivering breathing air to a user are known in the prior art. Such devices have different performance requirements depending on the circumstances in which they are intended to be used.

One critical application for air delivery devices are situations in which users are required to work in environments with toxic materials or gases. One group of workers who frequently are required to work under such conditions are firefighters. Breathing devices intended for use in toxic environments should minimize the risk of infiltration of toxic gases or materials into the lungs of a user.

Minimizing the infiltration of contaminants into an air delivery system used by a worker may be difficult due to the development of negative pressures when a worker inhales. Negative pressures developed in breathing masks or other delivery mechanisms may draw contaminants from the surrounding environment into the workers' air delivery system. The problem of infiltration of contaminants is particularly severe in situations where users engage in strenuous activity while wearing a breathing apparatus. Firefighters are commonly required to work under such conditions.

One approach that has been taken to minimize the risk of infiltration of contaminants into a breathing delivery system is the use of positive pressure breathing devices. Such devices deliver air to the user through a mask that effectively surrounds the user's nose and mouth. Air is delivered to the user through the mask at a positive pressure above atmospheric. Positive pressure is maintained so that the pressure in the mask is above atmospheric pressure at all times, and particularly while the user is consuming air by inhaling. By maintaining a positive pressure in the mask, any leakage of air will tend to be from the mask to the environment and not vice versa. This reduces the risk that contaminants will infiltrate the mask.

A variety of different approaches have been taken in the past to providing positive pressure in breathing devices. One approach has been to provide a breathing regulator that maintains a positive pressure in the mask at all times. When using a regulator of this type a user dons the mask, opens the regulator to a supply of air and the area in the mask quickly builds to a positive pressure. As the user inhales, air is delivered into the mask in sufficient quantity to maintain a positive pressure. When the user exhales, air from the user's lungs passes out of the mask through an exhaust valve. The exhaust valve opens at a pressure in excess of that which is maintained in the mask and closes when the pressure falls to the desired positive pressure level.

A problem with breathing devices of this type is that they only operate in a positive pressure condition. The user must control the flow of air to the mask with a manual valve. This poses drawbacks in that it may be difficult to place a valve within a user's easy reach. If the user must work wearing gloves or other protective equipment on their hands, it may be difficult to provide a valve that is readily manipulated. Another drawback is that a user in an emergency situation, may forget to open the air supply valve until contaminants have been drawn into the mask.

The problems associated with devices that operate only in a positive pressure mode have been reduced by breathing devices which have an "automatic-on" feature. Such breathing devices are capable of being placed in a standby mode in which no air flow occurs when they are off the user's face. When the user places a mask connected to an automatic-on type regulator device on his or her face and begins breathing, air is delivered to the mask. Once air delivery begins in response to a user's breathing, pressure in the mask automatically builds to a positive pressure.

Breathing devices which include the automatic-on feature eliminate the need to position a valve that can be manipulated by the user to begin the delivery of air. With automatic-on type devices, air is available as soon as the user begins to breathe. The risk that a user will put on his or her mask while forgetting to open a supply valve is also reduced. This is because the supply valve can remain open even when the breathing device is not planned for immediate use.

When a breathing apparatus that provides positive pressure is removed from the face, significant air will often escape. This is because the regulator operates to attempt to maintain a pressure above atmospheric in a confined space within a mask. As the mask is removed from the user's face the regulator delivers increasing amounts of air to try to build up a positive pressure until the regulator reaches a full flow condition. This may result in the loss of a significant amount of air until the user manually shuts off the airflow to the regulator.

In the past, mechanisms have been devised for breathing devices that provide automatic-on into positive pressure. These devices also provide for the manual shut off of airflow when the mask is removed from the face. Common mechanisms used for such purposes include toggle and latching levers and catch/release mechanisms. Such mechanisms respond to a user's inhalation to release a spring to act upon a diaphragm member which causes a valve to deliver air at positive pressure to a user. Such mechanisms must be mechanically re-latched to shut off the air delivery through the regulator.

Such prior art approaches have limitations and drawbacks. The drawbacks can include the limitations associated with the use of complex mechanisms for reliably and predictably releasing a flow of air in response to a user's inhalation effort.

Prior breathing devices have included a mask and a detachable regulator. In many devices having this configuration the regulator delivers air when the user inhales and provides an outlet path for air exhaled by the user. A regulator which operates in this manner is shown in U.S. Pat. No. 4,361,145. Fluid and condensation in the air exhaled by the user may collect in the regulator. Unless the regulator is disassembled and thoroughly cleaned after each use to eliminate contamination, diseases may be transmitted to subsequent users of the regulator.

Thus, there exists a need for a breathing apparatus for delivering air to a user that reduces contamination, provides automatic on into positive pressure and which conserves air when removed from the face.

DISCLOSURE OF INVENTION

It is an object of the present invention to provide a breathing apparatus for delivering air to a user.

It is a further object of the present invention to provide a breathing apparatus for delivering air to a user through a mask which maintains the mask at positive pressure.

It is a further object of the present invention to provide a breathing apparatus for delivering air to a user through a mask that causes the mask to automatically rise to a positive pressure in response to a user's breathing efforts.

It is a further object of the present invention to provide a breathing apparatus for delivering air to a user that minimizes the loss of air when removed from the user's face.

It is a further object of the present invention to provide a breathing apparatus which reduces contamination.

It is a further object of the present invention to provide a breathing apparatus for delivering air to a user that is durable and reliable.

Further objects of the present invention will be made apparent in the following Best Modes for Carrying Out Invention and the appended claims.

The foregoing objects are accomplished in the preferred embodiment of the invention by a breathing apparatus for supplying air to a user. The apparatus supplies air to a user at positive pressure in response to changes in pressure that result from a user's breathing efforts.

The apparatus includes a regulator. The regulator has a body which includes a sensing chamber and a positive pressure chamber. The sensing chamber is connected to the mask and it is exposed to the pressure therein. The pressure in the mask and sensing chamber fluctuates with the user's inhalation and exhalation. A flexible sensing diaphragm bounds the sensing chamber. The sensing diaphragm moves in response to the changes in pressure in the mask.

An air delivery valve that is connected to a supply of air, is in operative connection with the sensing diaphragm. In the preferred form of the invention the air delivery valve is a main valve that opens and closes in response to the opening and closing of a pilot valve. The sensing diaphragm moves a lever which opens and closes the pilot valve so that the main valve opens in response to a reduction in pressure in the mask caused by the user's inhalation.

The outlet of the main valve is also in fluid communication with the positive pressure chamber through a check valve. The check valve is oriented so that air may only flow into the positive pressure chamber.

A positive pressure diaphragm bounds the positive pressure chamber. The positive pressure diaphragm moves in a first direction in response to an increase in air pressure in the positive pressure chamber as a result of air passing the check valve. Movement of the positive pressure diaphragm in the first direction operates to bias the sensing diaphragm towards an air delivery position in which the air delivery valve is open.

A manually actuatable vent valve is fluidly connected to the positive pressure chamber. Air pressure in the positive pressure chamber is enabled to be released by actuation of the vent valve.

In one form of the invention the regulator may be releasibly attached directly to a mask. The mask has a mating connector to receive the regulator. In this form of the invention the mask also includes an exhalation valve which enables the passage of air from the facepiece at a predetermined level above atmospheric when the user exhales.

In another form of the invention the regulator is releasibly attached to an adaptor. The adaptor is releasibly attached to the mask. The adaptor includes a chamber which is in connection with the mask. The adaptor also includes an exhalation valve which enables the passage of air out of the adaptor to atmosphere when the pressure in the adaptor chamber exceeds a predetermined level above atmospheric. Both forms of the invention reduce contamination and the risk that diseases will be transmitted between users of the regulator.

In embodiments of the invention the regulator is releasibly connected to the mask. The mask includes a nose cup that covers a user's nose and mouth. The nose cup includes one or more check valves thereon. The check valve enables flow only from the area in the mask outside the nose cup to the interior of the nose cup, and blocks flow in the opposite direction. Air that is delivered from the air delivery valve of the regulator is delivered into the mask in the area outside the nose cup. In one form of the invention the sensing chamber of the regulator is in communication with the interior of the nose cup. As a result, the nose cup serves as a fluid divider member which in combination with the flow control provided by the check valve enables accurate sensing of the pressure in the mask while air is being delivered thereto. In another form of the invention the sensing chamber is connected to an area outside the nose cup into which the air is delivered.

With the mask and regulator combination off the face, the sensing diaphragm is initially positioned to close a pilot opening of the pilot valve. In this condition no airflow is delivered to the mask. Upon the user donning the mask and inhaling, negative pressure is transmitted to the sensing chamber, moving the sensing diaphragm so as to open the pilot valve. The opening of the pilot valve creates a pressure differential across a valve disk element of the main valve. This causes the main valve to open.

The main valve delivers air both to the mask as well as to the positive pressure chamber. The increased pressure in the positive pressure chamber moves the positive pressure diaphragm to apply a biasing force to the sensing diaphragm. The application of the biasing force biases the sensing diaphragm toward a valve opening position. As a result, air is delivered into the mask until a positive pressure is achieved therein.

Exhalation by the user wearing the mask causes the pressure in the mask to reach a higher level due to exhalation pressure. This elevated pressure in the mask opens the exhalation valve. The exhalation valve remains open until the user stops exhalation. The exhalation valve closes at a pressure above atmospheric to maintain positive pressure in the mask.

BEST MODES FOR CARRYING OUT INVENTION

Figure 1:
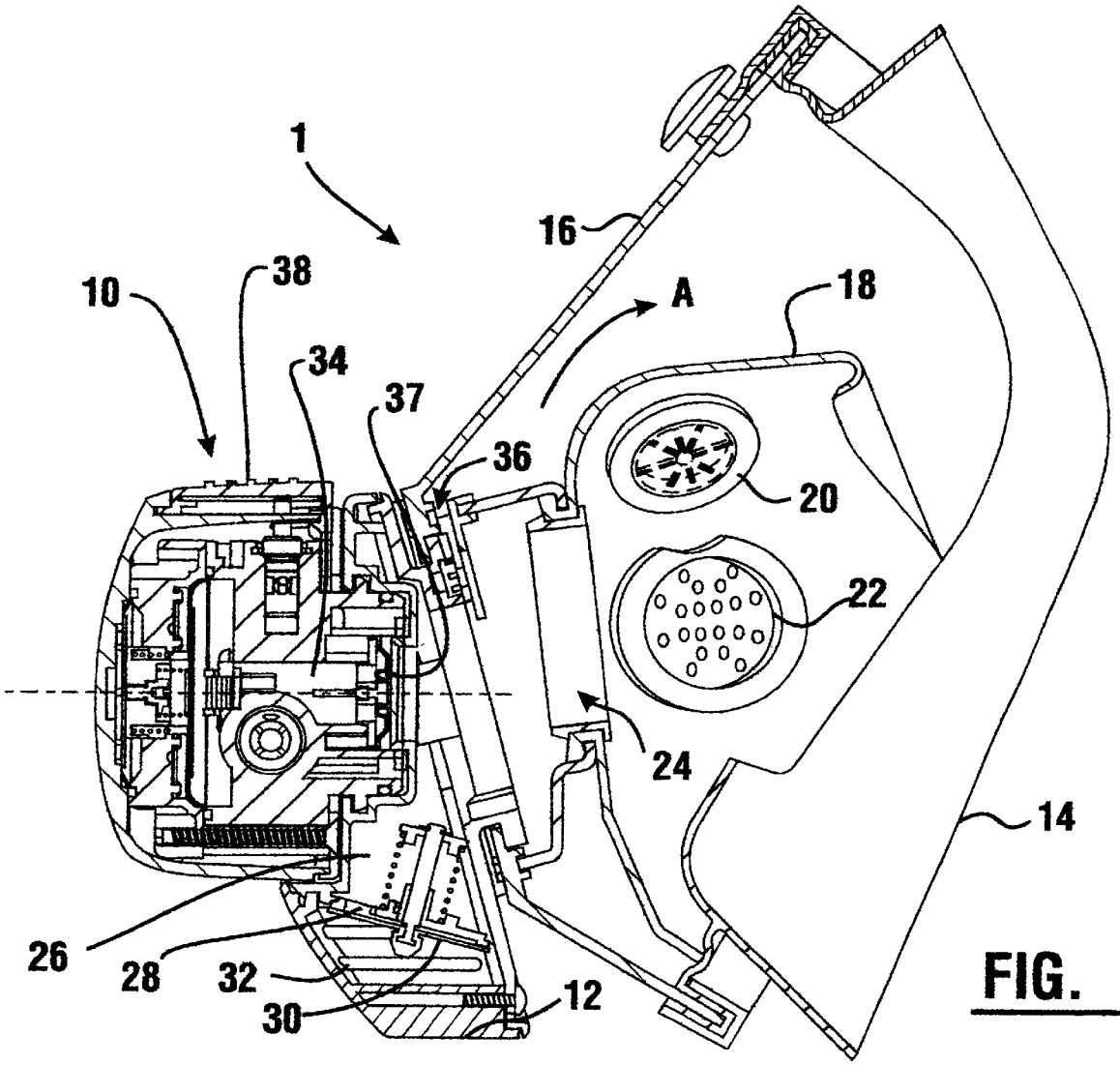
FIG. 1 is a cross sectional schematic view of one embodiment of a breathing apparatus of the present invention, including a regulator, an adaptor and a mask.

Referring now to the drawings and particularly to FIG. 1, there is shown therein an embodiment of the breathing apparatus of the present invention generally indicated 1. The breathing apparatus includes a regulator generally indicated 10. The regulator is releasibly attached to an adaptor 12. Adaptor 12 is attached to a mask 14. The adaptor is shown in more detail in FIG. 6 and the mask is shown in more detail in FIG. 7. It should be understood that in the preferred form of the invention, mask 14 is of the type that includes a faceplate 16 which is connected to other components which surround the face of a user in airtight relation. Faceplate 16 includes a transparent lens.

Mask 14 includes a nose cup 18 therein. Nose cup 18 is configured to cover the nose and mouth of the user in close fitting relation. In the embodiment shown in FIG. 1 the nose cup 18 serves as a fluid divider which divides an area outside the nose cup from an area inside the nose cup. Nose cup 18 includes flow controlling check valves 20. Valves 20 are of the disk type and enable flow from the outside to the inside area of the nose cup while preventing flow in an opposite direction. Nose cup 18 also has supported thereon a duct 22. Duct 22 transmits the sound of a user's voice to a voice emitter located on the lens of the mask (see FIG. 7). This enables a user's voice to be heard while wearing the mask.

Nose cup 18 has a central opening 24 which is open through the front of the mask to a chamber 26 in the adaptor. Chamber 26 includes an outlet 28. Airflow through outlet 28 is controlled by an exhalation valve 30. Exhalation valve 30 is a disk type valve that is spring loaded to a closed position. Valve 30 is configured to allow air to escape from chamber 26 when the pressure in the chamber is at a predetermined level above ambient atmospheric pressure. Exhalation valve 30 is configured to prevent air flow from atmosphere into the chamber 26 inside the adaptor.

Figure 6:
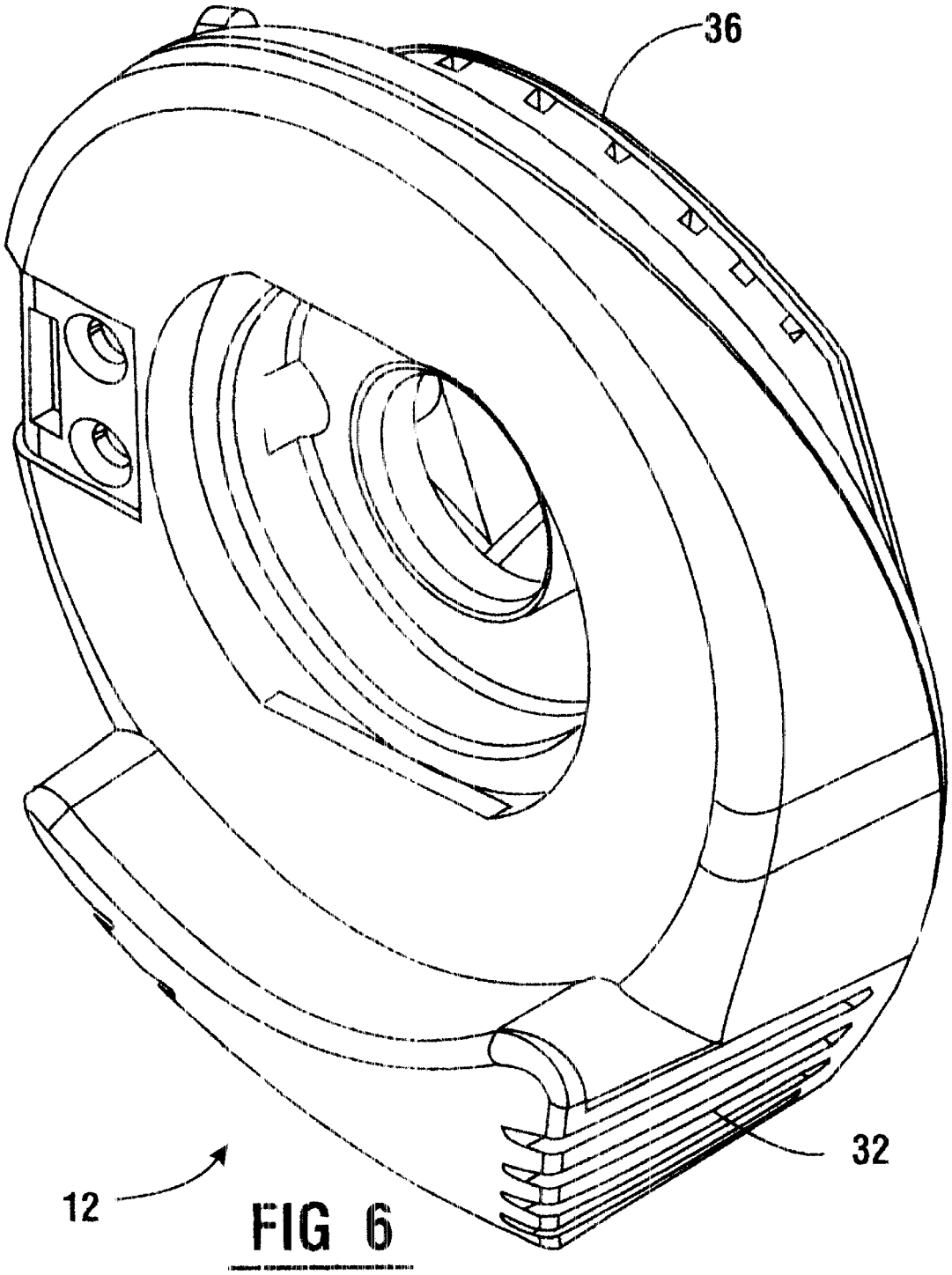
FIG. 6 is an isometric view of the adaptor.
Figure 7:
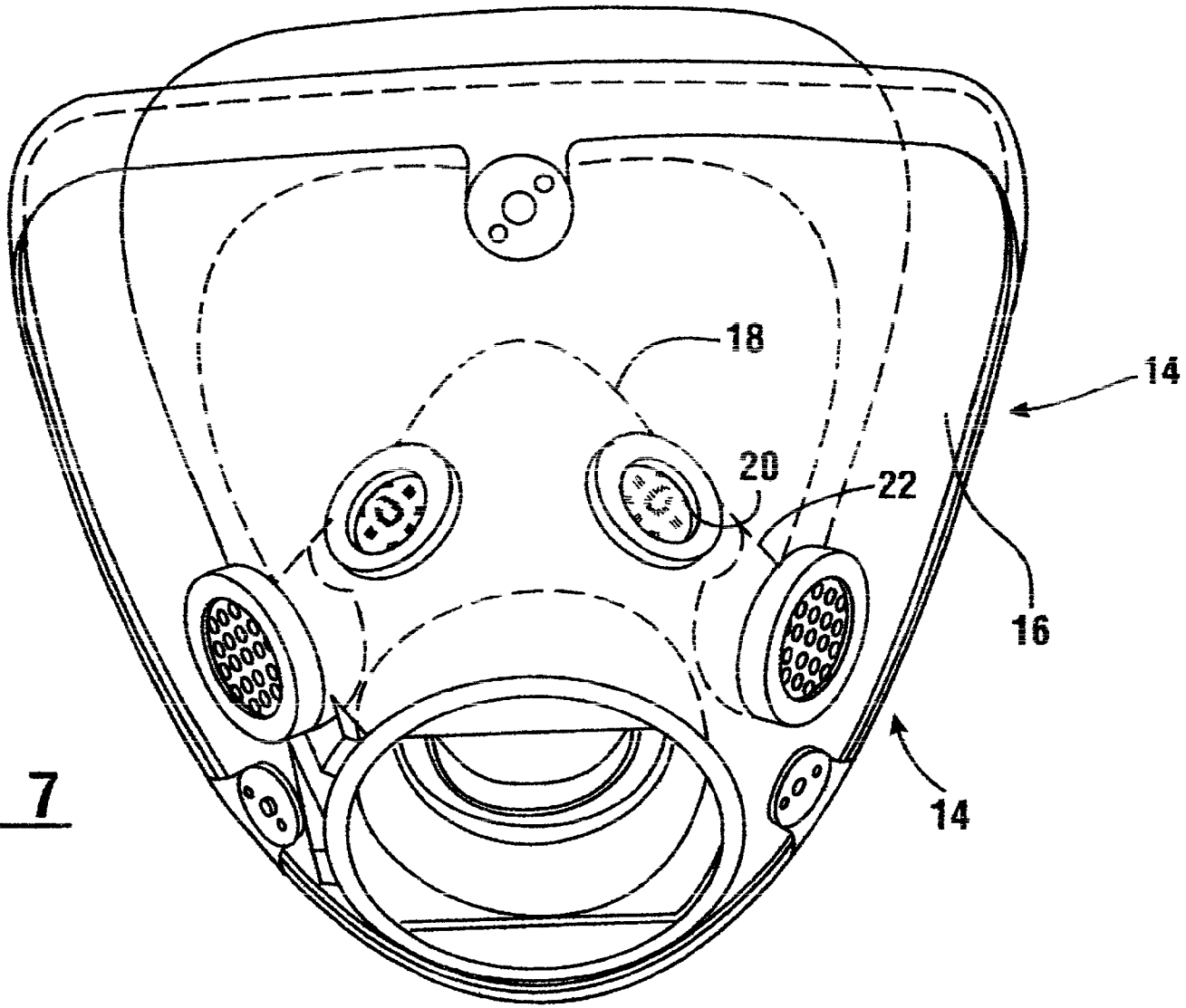
FIG. 7 is a front plan view of the mask.

Exhalation valve 30 is housed inside of a slotted or otherwise vented cover area 32 at the lower side of the adaptor. As shown in FIG. 6 slotted cover area 32 serves to enable air to flow from the outlet to atmosphere through slotted air delivery openings while preventing damage to the exhalation valve due to heat, flame or impact.

Regulator 10 is in fluid communication with chamber 26 through a sensing opening 34. Regulator 10 delivers air to the mask from a supply of pressurized air responsive to a user's inhalation. The air is delivered through an outlet passage in the regulator (not shown). A further passage conducts air from the regulator through the adaptor. Air is delivered out of the adaptor and into the mask through a plurality of air delivery openings 36. When the adaptor is connected to the mask the air delivery openings 36 are positioned in the mask in the area outside the nose cup. The air delivery openings are positioned so that air delivered therefrom flows across the lens. This minimizes fogging of the lens.

Air delivered from regulator 10 passes through openings 36, then passes through check valves 20 to the user's mouth and nose as indicated by Arrow A in FIG. 1. Air exhaled by the user passes through central opening 24 and into chamber 26 in the adaptor 12. Air exhaled by the user then passes out of the adaptor through outlet 28 and exhalation valve 30.

As shown in FIG. 1, adaptor 12 includes a check valve 37 thereon. When the regulator is in operative position, check valve 37 is positioned adjacent an entrance to the sensing opening 34 of the regulator 10. Check valve 37 readily enables air flow from sensing opening 34 into chamber 26 of the adaptor, and generally restricts air flow in the opposite direction. Check valve 37 enables a drop in air pressure in the mask caused by a user's inhalation to be transmitted in a first direction and immediately sensed through the sensing opening, but restricts the transmission of air in an opposed direction in response to a rise in air pressure due to a user's exhalation.

In the form of the breathing apparatus shown, regulator 10 and adaptor 12 are both connected to the mask in releasible, quick disconnect fashion. This is done through a quarter turn connector mounting whereby the regulator and adaptor are connected by inserting a projection on the regulator into a recess in the adaptor and turning the regulator a quarter turn. Likewise in the form of the invention shown the adaptor and the mask are connected in a releasible, quick disconnect fashion using a quarter turn connector mounting. The adaptor and the mask are connected by insertion of a projection on the adaptor into a recess in the mask and turning the adaptor relative thereto a quarter turn. The connections between the regulator and adaptor, and the adaptor and the mask, are gasketed so as to provide a fluid tight seal at each connection. As later discussed the releasible connector on the mask is suitable for engagement with the adaptor or alternatively with a prior art type regulator which provides an exhalation path through the regulator.

It should be understood that in other embodiments of the invention the regulator may be mounted directly to the mask. This may be done in a releasible or non-releasible manner. In such embodiments provision must be made on the mask for a suitable exhaust outlet directly from the mask to atmosphere.

It should be further understood that the regulator 10 is maintained in connection with a supply of pressurized breathing air such as a pressure vessel (not shown). Air from the supply is controlled by a first stage pressure regulator and appropriate valving (not shown) between the regulator 10 and the supply. The regulator 10 includes an external shutoff button 38 that can be readily actuated by a user wearing gloves. The purpose of shutoff button 38 is later explained in detail.

Figure 2:
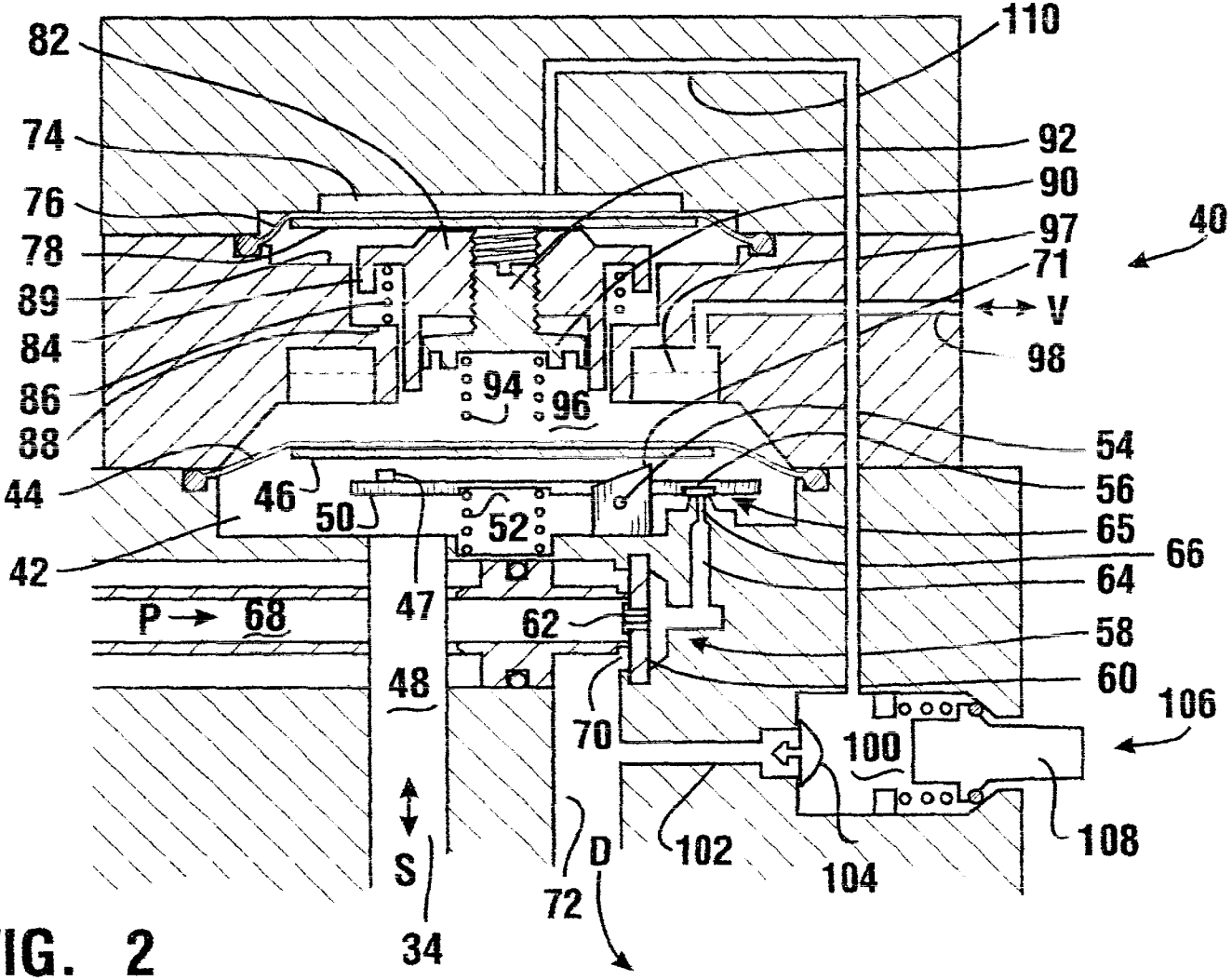
FIG. 2 is a cross sectional schematic view of the regulator of the breathing apparatus of the present invention shown in an off condition.

A schematic view of the regulator 10 of the breathing apparatus of the present invention is shown in FIG. 2. The regulator includes a body generally indicated 40, which is comprised of a plurality of connected pieces for ease of fabrication. The body includes a sensing chamber generally indicated 42. Chamber 42 is bounded by a sensing diaphragm 44 which serves as a first movable member bounding sensing chamber 42. Sensing diaphragm 44 is a flexible, airtight diaphragm. It has a generally rigid plate 46 mounted thereon which spans its central portion. Sensing chamber 42 is open to a sensing passage 48 which is in fluid communication with the sensing opening 34. As a result, sensing diaphragm 44 is movable responsive to the pressure changes in the mask which are transmitted through check valve 37 and into the sensing chamber 42 through passage 48 as indicated by Arrow S.

A lever 50 is pivotally mounted in sensing chamber 42. Lever 50 is biased by a compression spring 52 to rotate in a clockwise direction about a pin 54 as shown in FIG. 2. Lever 50 has a pad 56 comprised of resilient material thereon. Pad 56 serves as part of a pilot valve as later discussed. Lever 50 has a dimple 47 thereon. Dimple 47 may be a fixed raised area or in alternative embodiments may be adjustable such as by threaded attachment to lever 50.

Sensing chamber 42 also houses an angled pivot post 71. Pivot post 71 is positioned above pin 54. Pivot post 71 is positioned away from the center of plate 46. As later explained, pivot post 71 acts so that lever 50 moves in an oscillating tilting fashion responsive to pressure changes in the sensing passage 48.

A main valve generally indicated 58, is positioned in body 40. Main valve 58 is a disk type valve which includes a flexible valve disk element 60. Valve disk element 60 has supported thereon an insert comprised of rigid material having a precisely sized orifice 62 therethrough. Orifice 62 extends across valve disk element 60 and enables the passage of air therethrough at a low flowrate.

Orifice 62 is in fluid communication with a passage 64. Passage 64 is in connection with a pilot opening 66 of a pilot valve 65. The pilot opening 66 is shown blocked by resilient pad 56 in FIG. 2 such that the pilot valve is closed. The flow area of pilot opening 66 is preferably greater than the flow area of orifice 62.

Air from the supply is delivered to a main passage 68 as indicated by Arrow P. Main passage 68 terminates in a seat portion 70 which is shown in blocked, abutting relation with valve disk element 60 in FIG. 2. Because pilot opening 66 is blocked by pad 56 in the position shown in FIG. 2, the pilot valve 65 is closed and no air passes therethrough. With the pilot valve closed the pressure on each side of valve disk element 60 equalizes due to the flow through orifice 62. As a result, valve disk element 60 is maintained in abutting relation with the face of seat portion 70 and no air passes from main passage 68 through the main valve 58.

Figure 3:
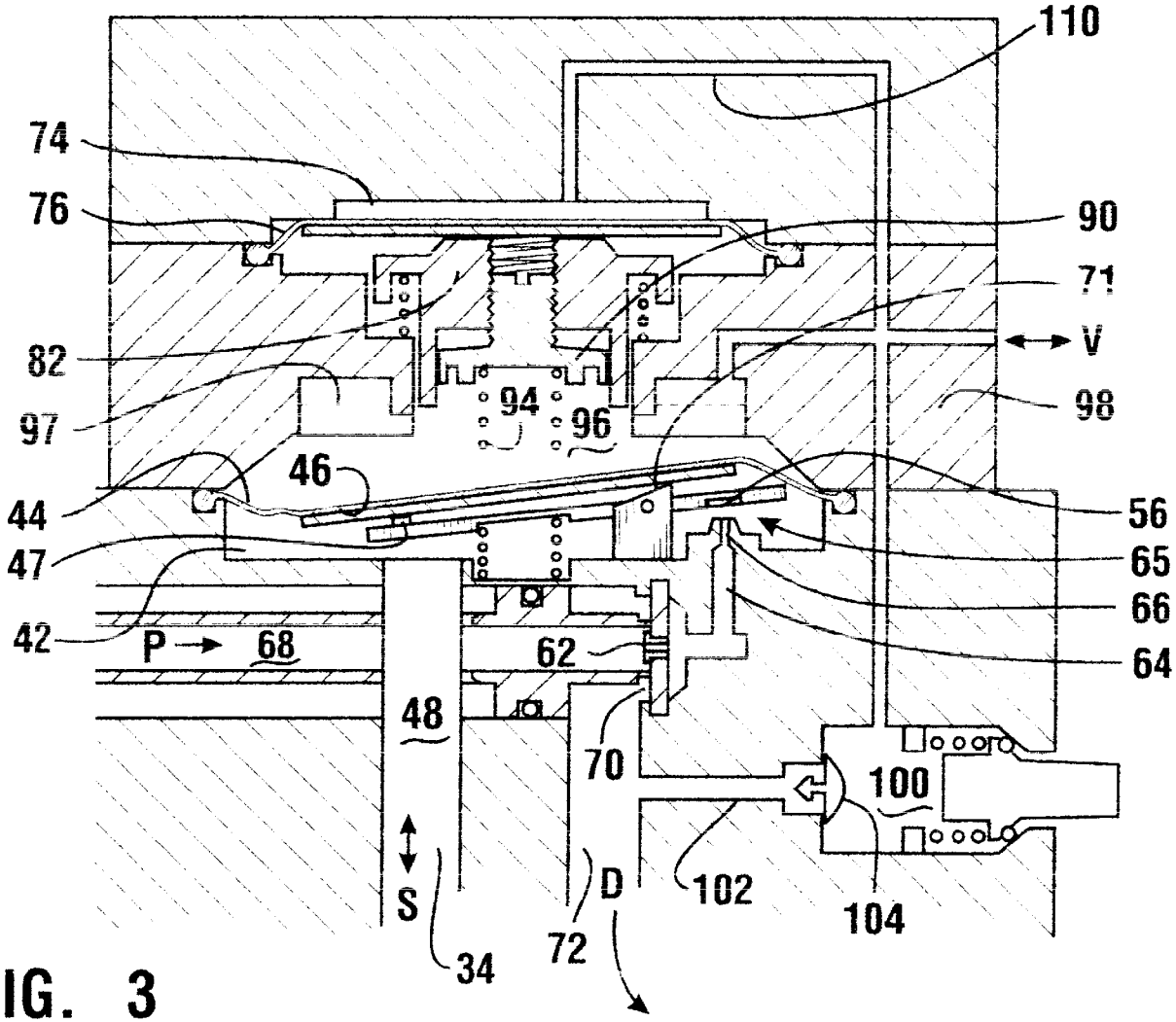
FIG. 3 is a cross sectional schematic view of the regulator similar to FIG. 2 wherein the sensing diaphragm is moved in response to a user's inhalation.

As later explained in detail with reference to FIGS. 3 and 4, when the pad 56 is disposed away from pilot opening 66, air is enabled to flow through passage 64. Because the air flow through pilot opening 66 is greater than the air flow through orifice 62 due to their respective flow areas, the air pressure acting on the right side of valve disk element 60 becomes less than the pressure acting on the left side through seat portion 70. The pressure difference deforms the valve disk element 60 away from seat portion 70 and air is enabled to pass around the seat and to an outlet 72 as indicated by Arrow D. Outlet 72 is in fluid communication through the regulator 10 and adaptor 12 with the air delivery openings 36 in the mask as shown in FIG. 1.

Body 40 further includes a positive pressure chamber 74. Positive pressure chamber 74 is bounded by a positive pressure diaphragm 76 which serves as a second movable member. Positive pressure diaphragm 76 is a fluid tight resilient member that is movable responsive to the pressure in the positive pressure chamber. Positive pressure diaphragm 76 has a plate 78 attached thereto which spans the central portion thereof.

A movable plunger member 82 is positioned adjacent to plate 78. Plunger member 82 includes a raised central area. Plunger member 82 includes an annular flange portion 84 which serves as a guide for a return spring 86. Plunger member 82 is movable in a bore. Return spring 86 is supported on an inward extending annular lip 88 inside the bore. The bore is bounded adjacent to plate 78 by a radially extending face 89.

A spring support member 90 is adjustably mounted on plunger member 82. Spring support member 90 includes a threaded stem portion 92 which is engaged in a threaded bore in plunger member 82. Rotation of spring support member 90 enables it to be selectively positioned in an axial direction relative to the plunger member which changes the axial length of the assembled members. In alternative embodiments of the invention the spring support member may not be selectively positionable relative to the plunger member. A positive pressure spring 94 is attached to spring support member 90. Positive pressure spring 94 is positioned in a recess in the lower face of spring support member 90 and is held in attached relation thereto as shown in FIG. 2.

Plunger member 82 and spring support member 90 are movable in an intermediate area generally indicated 96, which extends between the sensing diaphragm and the positive pressure diaphragm. Intermediate area 96 includes the bore in which plunger 82 is movable. Intermediate area 96 is in fluid communication with the atmosphere through a vent passage 98. Air is enabled to pass to and from the vent passage 98 as indicated by Arrow V. A membrane 97 extends in chamber 96. Membrane 97 is preferably comprised of PTFE or other material which enables air to pass readily therethrough but restricts the passage of water. Membrane 97 minimizes the risk that water will enter chamber 96 through the vent passage 98 and interfere with the operation of the regulator. The plunger member 82 and the spring support member 90 serve as a mechanism for operatively connecting and for transmission of force between the sensing diaphragm 44 and the positive pressure diaphragm 76 as explained in connection with the operation of the regulator.

Outlet 72 of main valve 58 is in fluid communication with a relief chamber 100 as well as with the mask. Relief chamber 100 is connected to outlet 72 through a passage 102 which terminates at a check valve 104. Check valve 104 is of the resilient member type and enables flow only from passage 102 into relief chamber 100, while preventing flow in the opposite direction.

Relief chamber 100 has a vent outlet 106. Vent outlet 106 is normally maintained closed as a result of being blocked by a spring loaded vent valve 108. Vent valve 108 is in operative connection with shutoff button 38. A positive pressure passage 110 extends from relief chamber 100 to positive pressure chamber 74 which is the area shown above positive pressure diaphragm 76 in FIGS. 2 through 4.

In operation of the regulator, air from the supply is delivered to main passage 68. However, with mask 14 off a user's face, sensing passage 48 is at atmospheric pressure. In this condition, spring 52 biases lever 50 to close pilot opening 66 of the pilot valve 65 as shown in FIG. 2. With pilot opening 66 closed, valve disk element 60 is positioned in abutting relation against the face of seat portion 70. As a result, no air flows through the main valve 58.

When a user dons the mask and inhales, a negative pressure is transmitted from the mask, through check valve 37 and to sensing passage 48. Sensing diaphragm 44 in sensing chamber 42 moves responsive to the negative pressure transmitted from the mask through the adaptor and check valve 37. Plate 46 and sensing diaphragm 44 move downward, engage pivot 71 and are caused to tilt as they move further downward as shown in FIG. 3. The plate 46 engages the dimple 47 on lever 50 and causes lever 50 to rotate from the position shown in FIG. 2 in a counterclockwise direction.

The movement of lever 50 opens pilot valve 65 by moving resilient pad 56 away from pilot opening 66. This results in an imbalance of pressure forces acting on valve disk element 60 of the main valve 58. The imbalance of forces occurs because the air pressure is no longer equal on both sides of the valve disk element.

When the pressure drops on the pilot valve side of the valve disk element 60, the valve disk element deforms and is disposed away from seat portion 70. This enables air to flow from main passage 68, radially outward about the valve disk element, to outlet 72. As previously explained, outlet 72 is connected to air delivery openings 36 in the mask. As a result, air is delivered to the user when he or she inhales.

The delivery of air to outlet 72 also causes air to flow past check valve 104 and elevates the pressure in chamber 100. The increased pressure in chamber 100 is transmitted through passage 110 to positive pressure chamber 74.

Figure 4:
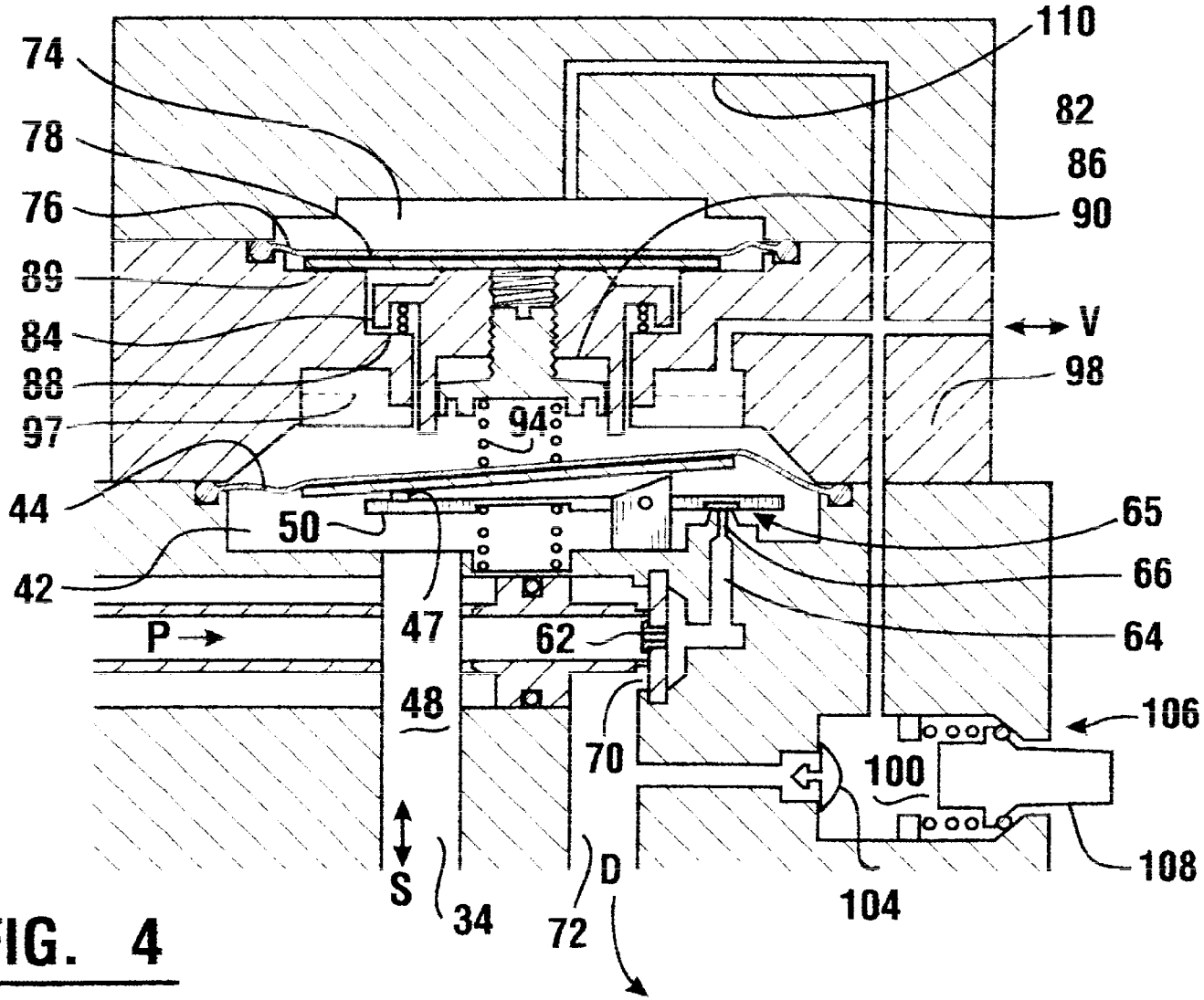
FIG. 4 is a cross sectional schematic view of the regulator similar to FIG. 2 but with the regulator shown in a positive pressure condition.
Figure 5:
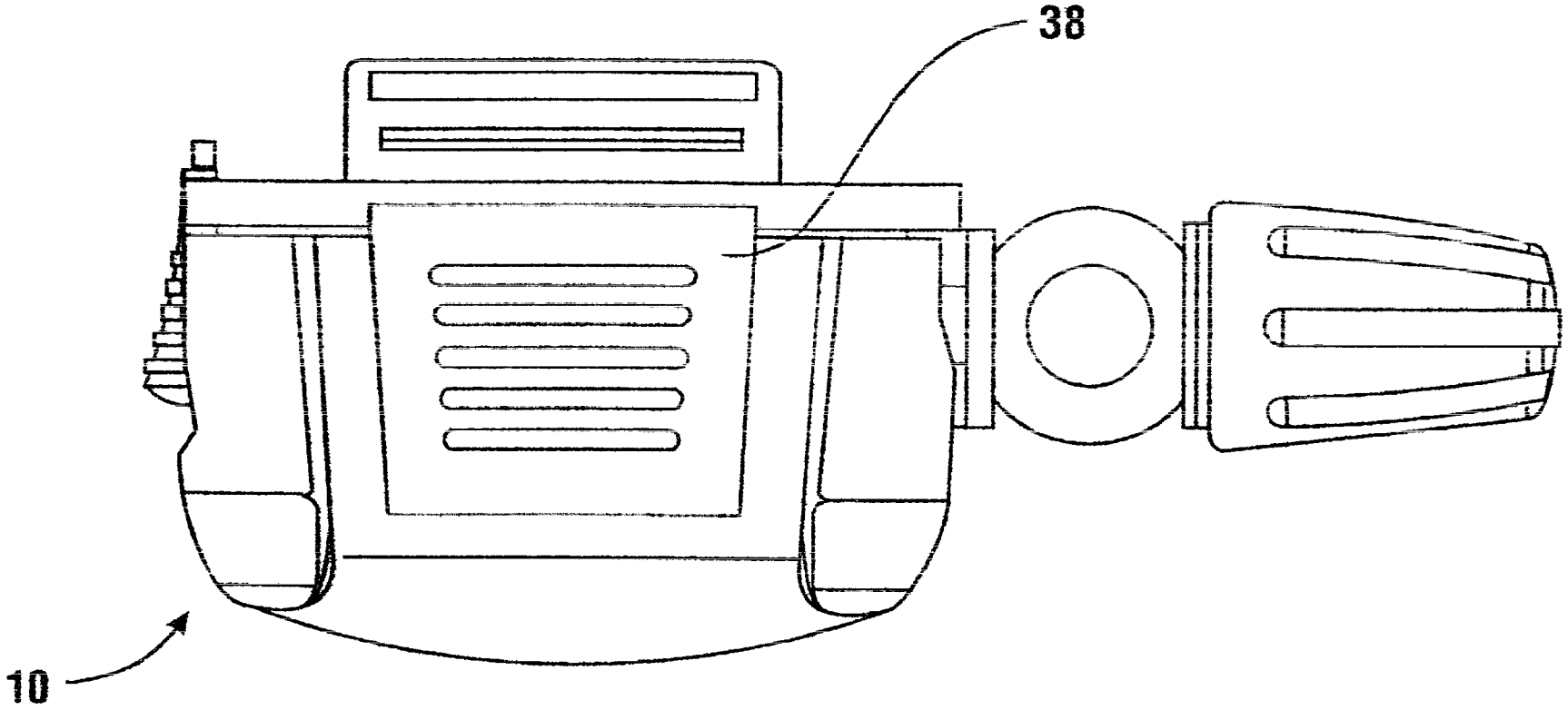
FIG. 5 is a top plan view of the regulator shown disconnected from the adaptor and mask.

As shown in FIG. 4, increased pressure in positive pressure chamber 74 moves positive pressure diaphragm 76 and plunger member 82 in a downward direction from the position shown in FIG. 2 to the position shown in FIG. 4. Plunger 82 moves downward against the force of return spring 86 until the plate 78 engages radially extending face 89, which together act as a stop.

In the downwardly disposed position of plunger member 82, spring support member 90 correspondingly moves so that positive pressure spring 94 engages sensing diaphragm 44. When positive pressure spring 94 engages sensing diaphragm 44 it biases the sensing diaphragm in a direction which tends to rotate lever 50 to open pilot opening 66. As a result, a positive pressure builds in the mask until the force acting against sensing diaphragm 44 is sufficient to move the sensing diaphragm so that lever 50 rotates to again close pilot valve 65. It should be noted that while in the preferred embodiment a mechanical connecting mechanism with an adjustable member is used to transmit force from the positive pressure diaphragm to the sensing diaphragm, in other embodiments or mechanisms employing fluids and/or other types of members may be used to perform this function.

In the manner just described the inhalation of air by a user in the mask causes the regulator to go from a standby condition in which no air is delivered, to a condition where positive pressure automatically builds in the mask. This enables the breathing apparatus of the present invention to provide "automatic-on" delivery which has the many advantages previously discussed. The mask will continue to operate at positive pressure to supply air to the user.

It should be mentioned that in the form of the invention shown in FIG. 1, air from the regulator 10 is delivered into the mask 14 outside the nose cup 18 which serves as a divider. The user receives air from the area outside of the nose cup through the flow controlling check valves 20. This form of the apparatus separates the point of delivery of the air from the sensing passage in which pressure is sensed to determine if air should be delivered. The check valve 37 further separates the sensing diaphragm from chamber 26 and rapid transient pressure fluctuations which may occur therein. Check valve 37 also reduces contamination of the regulator 10 by minimizing the amount of exhaled air that can pass into the sensing chamber 42. This reduces the risk of transmission of disease from one user of the regulator to another.

When the user is ready to remove the mask, the regulator can be readily changed from the positive pressure condition. This is done by the user pressing shutoff button 38 which acts to open vent valve 108. This opens relief chamber 100 to atmosphere. As the pressure in relief chamber 100 drops, positive pressure diaphragm 76 moves responsive to the force of return spring 86 back to the position shown in FIG. 2. As a result, positive pressure spring 94 is no longer in contact with sensing diaphragm 44 and if the user no longer inhales in the mask, no air flows through main valve 58.

The present invention also enables a user to minimize the loss of air by depressing shutoff button 38 as the mask is being removed. This prevents the substantial loss of air that is common in other systems and conserves the air available in the supply. This may be important in situations where the air supply is limited.

It should be understood that while in the preferred embodiment the positive pressure chamber is pressurized using a mechanism including a check valve, other embodiments may include alternative approaches to pressurization of the positive pressure chamber. Other mechanisms for pressurizing the positive pressure chamber will suggest themselves to those skilled in the art from the teachings herein.

The construction of the embodiment of the invention shown in FIG. 1 also presents the advantage that the user's breath does not pass through the regulator 10 as it exits the apparatus. Rather, exhaled air passes out the adaptor 12. In alternative embodiments the air may flow directly out of an exhalation valve on the mask. This approach minimizes contamination of the regulator.

A further advantage of the embodiment of the breathing apparatus shown in FIG. 1 is that it can be used with a mask which is also suitable for use with a prior art type regulator which provides an exhalation path through the regulator. For example, mask 14 includes a connector suited for releasible connection with a regulator which both delivers air when the user inhales and exhausts the user's breath to atmosphere through passages in the regulator when the user exhales.

The adaptor 12 is preferably made to connect to the connector on mask 14 in the same manner as such a prior art regulator. The adaptor 12 in turn receives the regulator 10. In this manner, mask 14 can be used as part of the present invention or can be connected to a prior art regulator if necessary. This provides a significant advantage for users of the present invention who might otherwise need to maintain a stock of separate masks for use with prior art type regulators.

Figure 8:
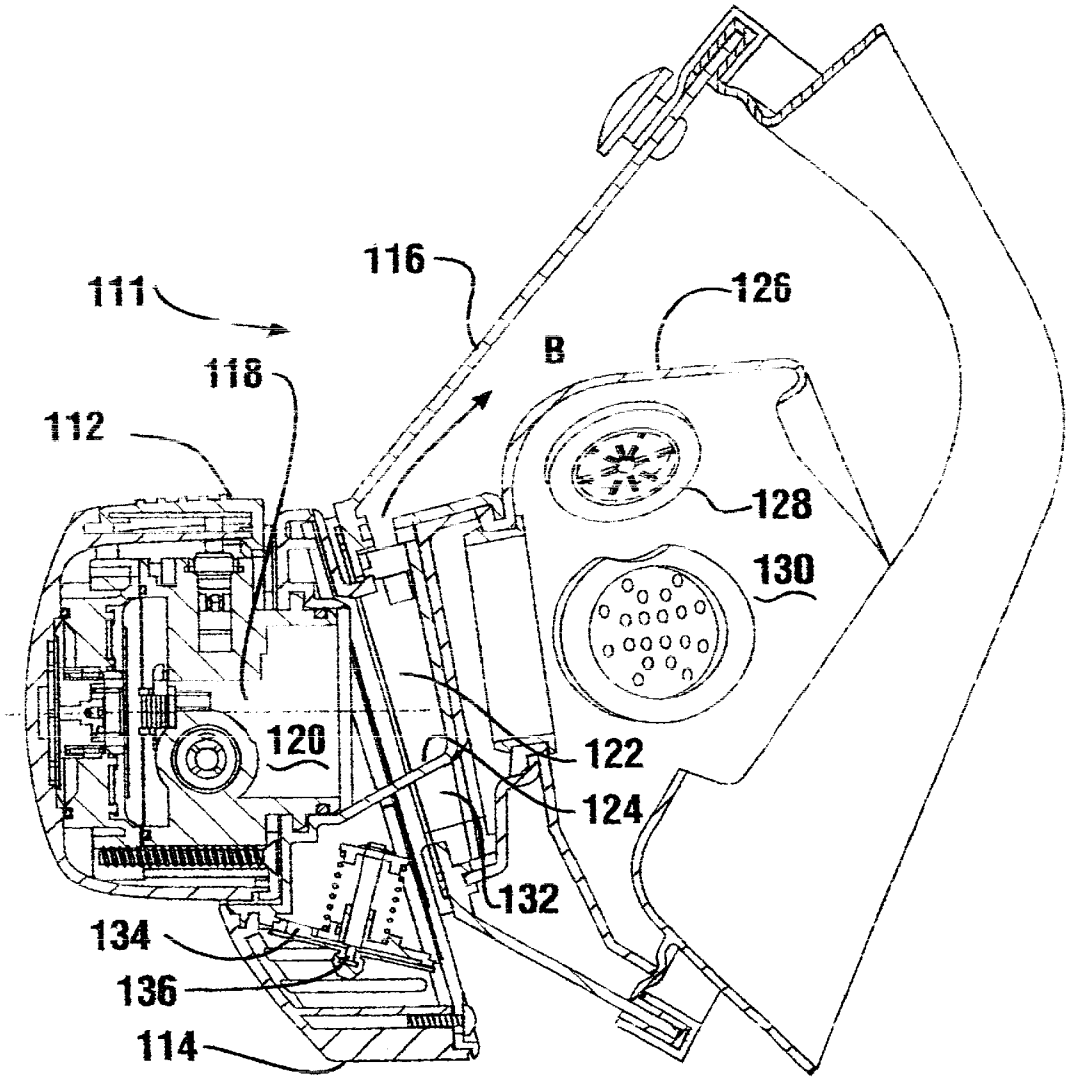
FIG. 8 is a cross sectional schematic view of an alternative embodiment of a breathing apparatus of the invention including a regulator, an adaptor and a mask.

An alternative embodiment of a breathing apparatus of the invention generally indicated 111 is shown in FIG. 8. Apparatus 111 is similar to apparatus 1 except as otherwise noted. Apparatus 111 includes a regulator 112, an adaptor 114 and a mask 116 which are releasibly connected to one another in a manner similar to the previously described embodiment.

Regulator 112 is similar to regulator 10 except that it has a sensing opening 118 which is open to a sensing bore 120. Sensing opening 118 is in fluid connection with a sensing passage in the regulator which is similar to the sensing passage described in connection with regulator 10.

Sensing bore 120 is in fluid communication with a first chamber 122 in the adaptor 114. Chamber 122 is bounded in the adaptor by a dividing wall 124. The dividing wall 124 fluidly separates first chamber 122 from an area inside a nose cup 126 in the mask 116. First chamber 122 is in fluid communication with the area of the mask outside the nose cup through openings (not separately shown). The nose cup 126 includes check valves 128 that enables air to pass from the area of the mask outside the nose cup to an interior area 130 of the nose cup.

Regulator 112 includes an outlet similar to outlet 72 described in connection with regulator 10. The outlet of regulator 112 is in fluid communication with an outlet passage through the adaptor 114. The outlet passage through the adaptor is connected to air delivery openings which deliver air from the regulator into the area of the mask 116 outside of nose cup 126. The air delivery openings preferably are positioned to deliver air so that it passes across the inside of the lens as indicated by Arrow B. As is the case with the first described embodiment, the flow of air across the inside of the lens reduces fogging.

The interior area 130 of nose cup 126 is in communication with a second area 132 in the adaptor 114. Second area 132 is maintained fluidly separated from first chamber 122 in the adaptor by dividing wall 124. Second area 132 is in fluid communication with an outlet 134 from the adaptor 114. An exhalation valve 136 controls flow out of the outlet and maintains a positive pressure in the mask in a manner similar to exhalation valve 30 in the previously described embodiment.

In operation of the breathing apparatus 111 the inhalation of a user wearing mask 116 reduces pressure in the interior area 130 of nose cup 126. This causes air to pass into the nose cup from the area outside the nose cup through check valves 128, and reduces the air pressure in the area of the mask outside of the nose cup. The pressure in first chamber 122 falls to the level in the area of the mask outside the nose cup. The reduced pressure is similarly sensed in the sensing bore 120 and the sensing opening 118 of the regulator 112. In response to this drop in pressure, air is delivered into the mask 116. As was the case with the prior embodiment, regulator 112 maintains the interior of the mask at a positive pressure.

When the user exhales the rise in pressure causes the delivery of air into the mask from the regulator to stop. The user's breath passes from the interior area 130 of the nose cup 126 and into the second area 132 of the adaptor 114. The rise in pressure in area 132 due to the user's exhalation opens exhalation valve 136 and the user's breath is exhausted to atmosphere through the outlet 134.

Breathing apparatus 111 presents an advantage in that the path for air exhaled by the user is isolated from the regulator 112. This further reduces the risk of contamination of the regulator by a user's bodily fluids.

Various types of movable members may be used in embodiments of the invention for performing the functions of the sensing diaphragm and the positive pressure diaphragm. In a preferred form of the invention convoluted diaphragms are used for both the sensing and positive pressure diaphragms.

Thus the new breathing apparatus of the present invention achieves the above-stated objectives, eliminates difficulties encountered in the use of prior devices and systems, solves problems and attains the desirable results described herein.

In the foregoing description, certain terms have been used for brevity, clarity and understanding. However, no unnecessary limitations are to be implied therefrom because such terms are for descriptive purposes and are intended to be broadly construed. Moreover, the descriptions and illustrations herein are by way of examples and the invention is not limited to the particular details shown and described.

In the following claims any feature described as a means for performing a function shall be construed as encompassing any means capable of performing the recited function, and shall not be limited to the particular means shown herein or mere equivalents.

Having described the features, discoveries and principles of the invention, the manner in which it is constructed and operated and the advantages and useful results attained; the new and useful structures, devices, elements, arrangements, parts, combinations, systems, equipment, operations and relationships are set forth in the appended claims.

I claim:

1. A breathing apparatus for supplying air at positive pressure responsive to a user's breathing efforts, comprising:

a mask;

a body, the body including a sensing chamber and a positive pressure chamber therein, the sensing chamber in fluid communication with the mask;

a first movable member bounding the sensing chamber, wherein the first member moves in response to pressure in the mask;

an air delivery valve in operative connection with the first member, the delivery valve having an outlet, wherein air is delivered to the outlet responsive to movement of the first member to an air delivery position, and wherein the outlet is in fluid communication with both the mask and the positive pressure chamber;

a check valve in intermediate fluid relation between the valve outlet and the positive pressure chamber, wherein the check valve enables flow only from the outlet to the positive pressure chamber; and a second movable member bounding said positive pressure chamber, wherein the second member moves in a first direction responsive to delivery of air to the positive pressure chamber, and wherein the second member is in operative connection with the first member, wherein movement of said second member in the first direction is operative to bias the first member towards the air delivery position.

2. The apparatus according to claim 1 and further comprising a selectively actuatable vent valve, wherein when the vent valve is open air pressure is relieved from the positive pressure chamber.

3. The apparatus according to claim 1 and further comprising a pilot opening, and wherein air flows through the delivery valve responsive to flow through the pilot opening, and wherein movement of the first movable member is operative to open and close the pilot opening.

4. The apparatus according to claim 3 and further comprising a movable lever, wherein the lever is in operative connection with the pilot opening and the first movable member, and wherein movement of the first movable member to the air delivery position is operative to move said lever to open the pilot opening.

5. The apparatus according to claim 1 wherein the first movable member is tiltably movable about a pivot post in the sensing chamber.

6. The apparatus according to claim 1 and further comprising a fluid divider and a flow control valve, wherein the flow control valve controls fluid flow through the divider, wherein the outlet is in fluid connection with a first side of the divider and the sensing chamber is in fluid connection with a second side of said divider.

7. The apparatus according to claim 6 wherein the fluid divider comprises a nose cup in the mask, wherein the nose cup is adapted to have a user's nose and mouth positioned on the second side of the divider, and wherein the flow control valve includes a check valve enabling flow from the first side to the second side of the divider and restricting flow in an opposed direction.

8. The apparatus according to claim 1 and further comprising a fluid divider and a flow control valve, wherein the flow control valve controls flow through the divider, wherein the outlet is in fluid connection with the first side of the divider and the sensing chamber is in fluid connection with the first side of the divider.

9. The apparatus according to claim 8 wherein the fluid divider comprises a nose cup in the mask, wherein the nose cup is adapted to have a user's nose and mouth positioned on the second side of the divider, and wherein the flow control valve includes a check valve enabling flow from the first side to the second side of the divider and restricting flow in an opposed direction.

10. The apparatus according to claim 8 and further comprising an adaptor, wherein the outlet and the sensing chamber are in fluid communication with the first side through the adaptor, and wherein the adaptor includes an exhalation outlet, and wherein the divider further comprises a dividing wall extending in said adaptor, wherein the second side is in fluid communication with the exhalation outlet, and wherein the dividing wall fluidly separates within the adaptor the second side from the sensing chamber.

11. The apparatus according to claim 1 and further comprising a stop, wherein the stop limits travel of the second member in the first direction, and further comprising a positive pressure spring operatively connecting said first member and the second member when said second member operatively biases said first member toward the air delivery position.

12. The apparatus according to claim 11 and further comprising a return spring, wherein the return spring is operative to bias the second member away from the stop.

13. The apparatus according to claim 12 and further comprising a selectively actuatable vent valve in operative connection with the second chamber, wherein actuation of the vent valve is operative to relieve pressure from the positive pressure chamber, and wherein the second member moves in an opposed direction in response to relief of pressure from the positive pressure chamber, whereby the first movable member is no longer biased toward the air delivery position.

14. The apparatus according to claim 1 wherein said first movable member comprises a flexible sensing diaphragm, and the second member comprises a flexible positive pressure diaphragm, wherein the diaphragms bound an intermediate area extending between said sensing chamber and said positive pressure chamber, and further comprising a vent, wherein the intermediate area is connected to atmosphere through said vent.

15. The apparatus according to claim 1 wherein the sensing chamber is in fluid communication with the mask through a sensing passage, and further comprising a check valve in operative connection with said passage wherein the check valve enables fluid flow in a first direction from the sensing chamber toward said mask and restricts fluid flow in an opposed direction.

16. The apparatus according to claim 1 wherein said apparatus comprises a regulator and adaptor, wherein the adaptor is releasibly connected to a first releasible connector on the mask, wherein the first movable member is mounted in the regulator, and wherein the adaptor includes an exhalation outlet, and an exhalation valve for operatively controlling flow from the outlet.

17. The apparatus according to claim 16 wherein the exhalation valve is operative to maintain a pressure above atmospheric pressure in the mask.

18. The apparatus according to claim 16 wherein the regulator is releasibly connected to the adaptor by a second releasible connector.

19. The apparatus according to claim 18 wherein the adaptor includes a divider therein, wherein the divider is operative to fluidly isolate air exhaled by a user in the mask from the sensing chamber.

20. The apparatus according to claim 16 wherein the first releasible connector is alternatively engageable with a regulator including an exhalation path therethrough.

21. The apparatus according to claim 1 wherein the second movable member is in operative connection with the first movable member by a connecting mechanism including an adjustably positionable member.

22. The apparatus according to claim 21 wherein adjustment of the positionable member is operative to change a length of the connecting mechanism in generally the first direction.

23. The apparatus according to claim 22 wherein the length of the connecting mechanism is changed responsive to rotational movement of the positionable member.

24. The apparatus according to claim 21 wherein the connecting mechanism includes a spring, wherein the first and second movable members are operatively connected through the spring.

25. The apparatus according to claim 24 wherein the connecting mechanism is not in operative connection with said first movable member until the second movable member moves in the first direction.

26. A breathing apparatus for supplying air at positive pressure responsive to a user's breathing efforts, comprising:

a mask;

a sensing chamber and a first movable member bounding the sensing chamber, wherein the first movable member moves responsive to pressure in the mask;

a positive pressure chamber and a second movable member bounding the positive pressure chamber;

an air delivery valve, wherein the air delivery valve is in operative connection with the first movable member and wherein the air delivery valve is operative to deliver air to the mask when the first movable member moves to an air delivery position responsive to a drop in air pressure in the mask;

a pressurizing mechanism, wherein the pressurizing mechanism is operative to pressurize the positive pressure chamber responsive to the delivery of air into the mask from the air delivery valve, wherein the second movable member moves from a first position to a second position responsive to the pressurization of the positive pressure chamber;

a force transmission mechanism, wherein the force transmission mechanism is operative to apply a force on the first movable member responsive to movement of the second movable member to the second position, wherein the force applied by the force transmission mechanism is operative to bias the first movable member toward the air delivery position.

27. The apparatus according to claim 26 and further comprising an outlet opening in fluid communication with the mask, and an exhalation valve controlling flow from the outlet opening, and wherein the exhalation valve is operative to prevent air flow into the mask through the outlet opening and enables air to exhaust from the mask through the outlet opening when a pressure in the mask is a predetermined level above atmospheric pressure.

28. A breathing apparatus for supplying air at positive pressure to a mask, the breathing apparatus comprising:

a body, wherein the body is adapted to be in connection with the mask, the body including a sensing chamber and a positive pressure chamber therein, the sensing chamber adapted to be in fluid communication with the mask;

a first movable member bounding the sensing chamber, wherein the first member is adapted to move in response to pressure;

an air delivery valve in operative connection with the first member, the delivery valve having an outlet, wherein air is delivered to the outlet responsive to movement of the first member to an air delivery position, wherein the outlet is in fluid communication with the positive pressure chamber, and wherein the outlet is adapted to be in fluid communication with the mask;

a check valve in intermediate fluid relation between the valve outlet and the positive pressure chamber, wherein the check valve enables flow only from the outlet to the positive pressure chamber; and a second movable member bounding said positive pressure chamber, wherein the second member moves in a first direction responsive to delivery of air to the positive pressure chamber, and wherein the second member is in operative connection with the first member, wherein movement of said second member in the first direction is operative to bias the first member towards the air delivery position.

29. A breathing apparatus for supplying air at positive pressure to a mask, the breathing apparatus comprising:

a sensing chamber, a first movable member bounding the sensing chamber, wherein the first movable member is adapted to move in response to a pressure;

a positive pressure chamber and a second movable member bounding the positive pressure chamber;

an air delivery valve, wherein the air delivery valve is in operative connection with the first movable member, and wherein the air delivery valve is operative to deliver air toward the mask when the first movable member moves to an air delivery position responsive to a change in air pressure;

a pressurizing mechanism, wherein the pressurizing mechanism is operative to pressurize the positive pressure chamber responsive to the delivery of air toward the mask from the air delivery valve, wherein the second movable member moves from a first position to a second position responsive to the pressurization of the positive pressure chamber;

a force transmission mechanism, wherein the force transmission mechanism is operative to apply a force on the first movable member responsive to movement of the second movable member to the second position, wherein the force applied by the force transmission mechanism is operative to bias the first movable member toward the air delivery position.

30. The apparatus according to claim 1 wherein positive pressure is initiated and maintained in the mask in response to a user's inhalation.

* * * * *